US008435095B1

(12) United States Patent
Abbas

(10) Patent No.: US 8,435,095 B1
(45) Date of Patent: May 7, 2013

(54) BUILDING BLOCK SYSTEM AND METHOD OF USE

(76) Inventor: Kassem Charif Abbas, Kuwait (KW)

( * ) Notice: Subject to any disclaimer, the term of this patent is extended or adjusted under 35 U.S.C. 154(b) by 298 days.

(21) Appl. No.: 12/807,981

(22) Filed: Sep. 17, 2010

Related U.S. Application Data

(60) Provisional application No. 61/277,471, filed on Sep. 26, 2009.

(51) Int. Cl.
*A63H 33/08* (2006.01)
*A63H 33/12* (2006.01)

(52) U.S. Cl.
USPC ..... 446/122; 446/127

(58) Field of Classification Search ..... 446/85, 446/106, 120–125, 127, 128; 52/281, 391, 52/586.1
See application file for complete search history.

(56) References Cited

U.S. PATENT DOCUMENTS

| | | | | |
|---|---|---|---|---|
| 3,640,039 | A * | 2/1972 | McKee et al. | 52/281 |
| 4,702,702 | A * | 10/1987 | Mikelsaar | 434/278 |
| 5,069,647 | A * | 12/1991 | Zuviria | 446/127 |
| 5,730,544 | A * | 3/1998 | Dils et al. | 403/292 |
| 6,450,853 | B1 * | 9/2002 | Larws | 446/93 |
| 6,874,291 | B1 * | 4/2005 | Weber | 52/586.1 |

* cited by examiner

*Primary Examiner* — Kien Nguyen
(74) *Attorney, Agent, or Firm* — Ted Masters

(57) ABSTRACT

A building block system includes building blocks which have elongated grooves on opposite faces. An elongated connector is received by the grooves of two adjacent building blocks and serves to hold the building blocks together. The connector is slightly wider than the grooves so it can be press fit into the grooves to ensure a tight fit. The connector is flexible so that it can be received by curved grooves, and the connector also has chamfered ends to facilitate insertion into the grooves. The system can be used to build structures containing a plurality of building blocks.

14 Claims, 5 Drawing Sheets

Fig. 1
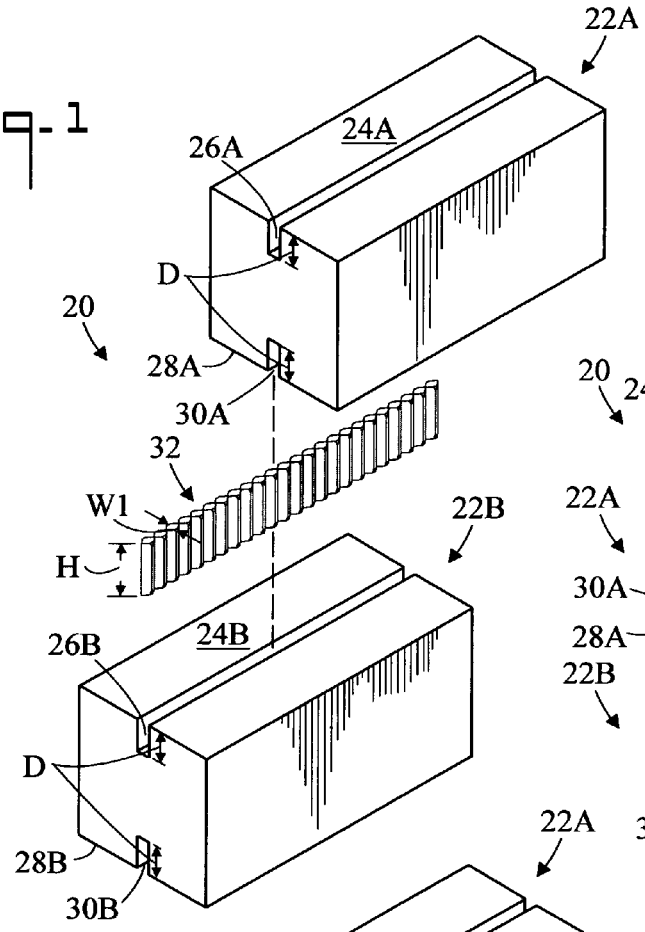
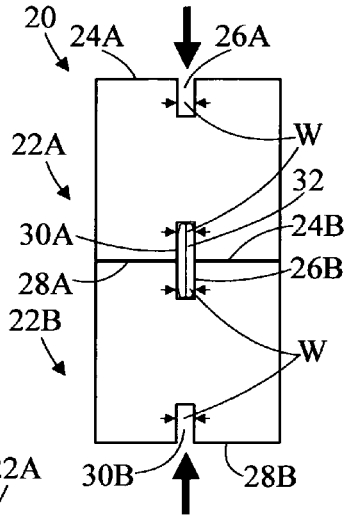
Fig. 3
Fig. 2
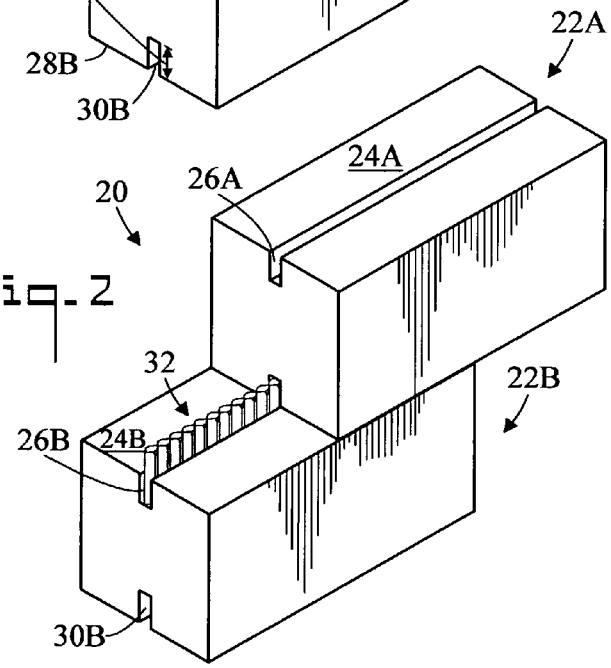

BUILDING BLOCK SYSTEM AND METHOD OF USE

CROSS REFERENCE TO RELATED APPLICATION

This application claims the filing benefit under 35 U.S.C. §119(e) of U.S. Provisional Application No. 61/277,471, filed Sep. 26, 2009, which is hereby incorporated by reference.

TECHNICAL FIELD

The present invention pertains generally to toys, and more particularly to a building block system and method which can be utilized to build various toy structures.

BACKGROUND OF THE INVENTION

Toy building blocks for use by children are well known in the art, and come in various shapes, sizes, colors, and structural components. The building blocks provide a creative stimulation by allowing a child to make a variety of different designs, can improve the child's coordination skills, and can teach the child different shapes, sizes, colors, etc. Some building blocks interlock so that the blocks may be fashioned into a stable rather than simply stacked structure. A particularly useful form of building blocks allows the child to build a house, building, or other structure.

BRIEF SUMMARY OF THE INVENTION

The present invention is directed to a building block system in which the building blocks are connected with elongated connectors which fit into grooves in the blocks. The blocks can be connected and fashioned into structures such as walls and roofs of various types which look very realistic. The building block system also includes doors, windows, balconies, and the like which can be integrated into the structure. The building blocks can be made of resin or other useful material, and can be painted different colors on their two opposite sides, or alternatively can have textured sides which simulate stone, brick, or other building materials.

Opposite sides of the building blocks each have a longitudinal groove. The building blocks are connected by an elongated flexible connector which fits (snaps) into the grooves and holds the blocks together. The connector is made of nylon (the same material used for cable ties) or another polymer, and is strong, flexible, and when fitted into the grooves becomes hidden. The finished structure becomes one connected unit which can be moved from place to place, and looks as if it were cast as a single unit. All other components of the structure (entrance doors, windows, balconies etc.) have the same groove structure so it can be placed at any desired location, thereby giving the user an opportunity to modify the position of those components and the final design using the same set of building blocks.

Some important features of the present invention include:

- The building block system can be used to build a simple cottage, a villa, or a multistory building using the same technique. The final structure is solid, strong and can be lifted as a single unit. It can also be torn down and reassembled into another structure.
- The system is modular in a way that the user can add new components (doors, windows etc.) and may purchase them as separately accessories.

- Building blocks of the present system can be connected horizontally or vertically, and do not require the presence of another block to hold them together (e.g. in some other building block systems, a third building block is required to connect two building blocks together).
- The sizes of the building blocks can be scaled (e.g. 1 inch=1 foot etc.) in order to make a structure having realistic proportions.
- The width of the connector is slightly greater than the width of the groove opening, and it will therefore compensate for any manufacturing tolerances. It may also have chamfered ends for easy insertion.
- The painting and texturing the two sides of the blocks differently allows the user to modify the look of the structure.
- The final building blocks can be made from a resin that is used to cast figurines because it is easy and inexpensive to make. A polymer, wood, metal, or other material could also be used to fabricated the building blocks.
- The roof members (tiles, shingles, etc.) can be caste and sold as one piece, or alternatively as tiles or shingles that can be connected the same way as the building blocks.
- The same design concept may be applied to interior walls with a thinner cross-section but still using the same connector.
- The building block system can be sold as a basic set containing enough blocks and other components to build a specific house or as bags which contain one kind of blocks (i.e a bag contains only one size of blocks, the other bag contains different color and texture, doors, windows and even rooftops are sold separately etc.) In this way the user may buy the sets that suits him or simply add to his basic collection.
- The connectors can be made in rolls and then cut to length by the user. Alternatively, the connectors can be sold in precut sizes.
- Doors and windows and other components can be made to look authentic by using real wood and colored acrylic for glass.
- The target users for the building block system include children, engineers, and model makers.

In accordance with a preferred embodiment a building block system includes a first building block having a first side having a first elongated groove and an opposite second side having a second elongated groove. The system further includes a second building block having a third side having a third elongated groove, and an opposite fourth side having a fourth elongated groove. An elongated connector is shaped and dimensioned to be simultaneously snuggly received by the second elongated groove of the first building block and the third elongated groove of the second building block thereby connecting the first and second building blocks together.

In accordance with another embodiment, the second elongated groove is oriented parallel to the first elongated groove, and the fourth elongated groove is oriented parallel to the third elongated groove.

In accordance with another embodiment, the first elongated groove is centered on the first side of the first building block, and the second elongated groove is centered on the second side of the first building block.

In accordance with another embodiment, the first and second elongated grooves of the first building block and the third and fourth elongated grooves of the second building block all having the same width W. The elongated connector has a width W1 which is slightly greater than the width W of the elongated grooves, so that the elongated connector can be press fit into the elongated grooves.

In accordance with another embodiment, the first, second, third, and fourth elongated grooves each having the same depth D. The elongated connector has a height H, wherein height H is approximately equal to two times depth D.

In accordance with another embodiment, the first elongated groove is curved, and the elongated connector is flexible so that it can be received by the curved first elongated groove.

In accordance with another embodiment, the elongated connector has a first serrated side and an opposite second serrated side.

In accordance with another embodiment, the elongated connector has a first chamfered end and an opposite second chamfered end.

Other possible embodiments, in addition to the possible embodiments enumerated above, will become apparent from the following detailed description, taken in conjunction with the accompanying drawings, which illustrate, by way of example, the principles of the building block system and method of use.

BRIEF DESCRIPTION OF THE DRAWINGS

FIG. 1 is an exploded perspective view of a building block system;

FIG. 2 is a perspective view of the system;

FIG. 3 is an end elevation view of the system;

DETAILED DESCRIPTION OF THE INVENTION

Referring initially to FIGS. 1-3, there are illustrated exploded perspective, perspective, and end elevation views respectively of a building block system, generally designated as 20. Building block system 20 includes a first building block 22A (top) which has a first side 24A having a first elongated groove 26A, and an opposite second side 28A having a second elongated groove 30A. In the shown embodiment second elongated groove 30A is oriented parallel to first elongated groove 26A. Building block system 20 further includes a second building block 22B (bottom) having a third side 24B having a third elongated groove 26B, and an opposite fourth side 28B having a fourth elongated groove 30B which is oriented parallel to third elongated groove 26B. In the shown embodiment, building blocks 22A and 22B are identical. Building block system 20 further includes an elongated connector 32 which is shaped and dimensioned to be simultaneously snuggly received by second elongated groove 30A of first building block 22A and third elongated groove 26B of second building block 22B thereby connecting first 22A and second 22B building blocks together. Simply put elongated connector 32 is snuggly received by the bottom groove of building block 22A and the top groove of building block 22B, thereby holding the two building blocks together. Connector 32 comprises a strip which is fabricated from nylon, other flexible polymer, or the like. Connector 32 is press fit into second elongated groove 30A of first building block 22A and into third elongated groove 26B of second building block 22B. As is shown in FIG. 3, the two building blocks 22 are urged together to the effect a firm connection of the blocks.

Figure 9:
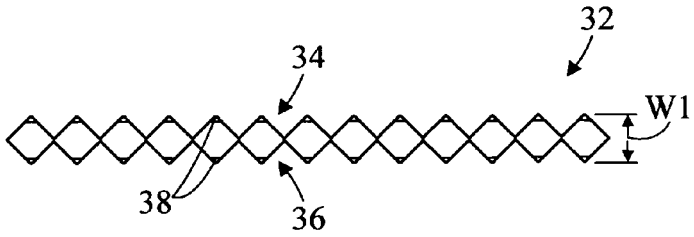
FIG. 9 is an enlarged top plan view of an elongated connector.
Figure 10:
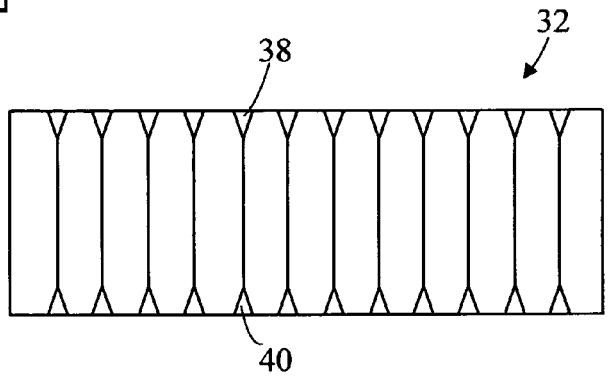
FIG. 10 is an enlarged side elevation view of the connector.
Figure 11:
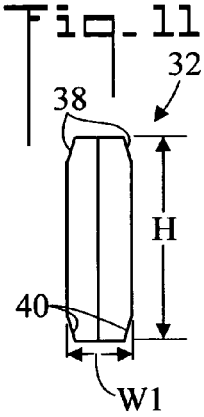
FIG. 11 is an enlarged end elevation view of the connector.
Figure 12:
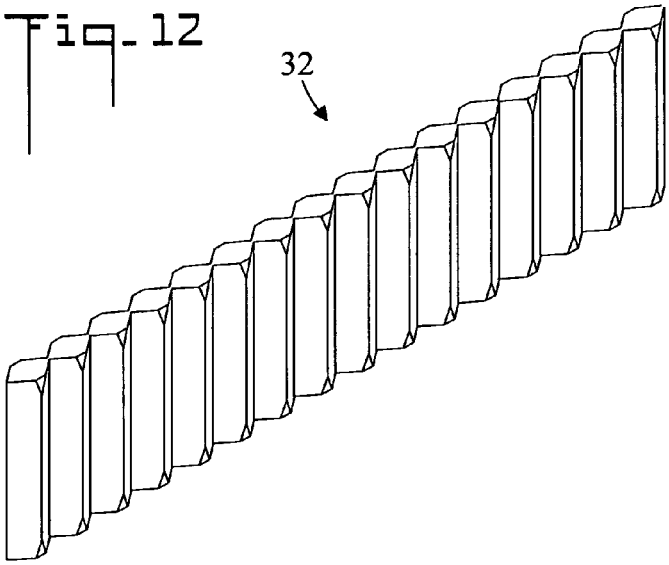
FIG. 12 is an enlarged perspective view of the connector.

First 26A and second 30A elongated grooves of first building block 22A and third 26B and fourth 30B elongated grooves of second building block 22B all have the same width W. Elongated connector 32 has a width W1 (also refer to FIGS. 9 and 11) which is slightly greater than width W of the elongated grooves. As such, elongated connector 32 can be press fit into elongated grooves 26A, 30A, 26B, and 30B, thereby effecting a connection which firmly holds the blocks together. In an embodiment, first 26A, second 30A, third 26B, and fourth 30B elongated grooves have the same depth D. Elongated connector 32 has height H, wherein height H is approximately equal to two times depth D, so that when two building blocks are connected together, elongated connector 32 substantially fills the two grooves (refer to FIG. 3).

Figure 4:
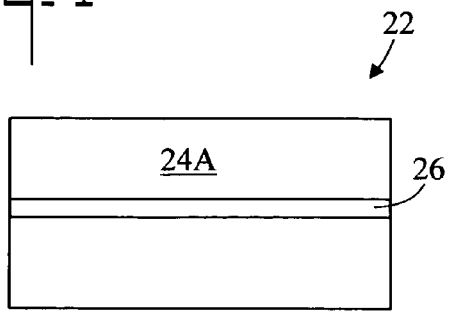
FIG. 4 is a top plan view of a building block.
Figure 5:
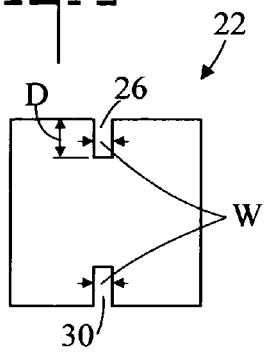
FIG. 5 is an end elevation view of the building block.
Figure 6:
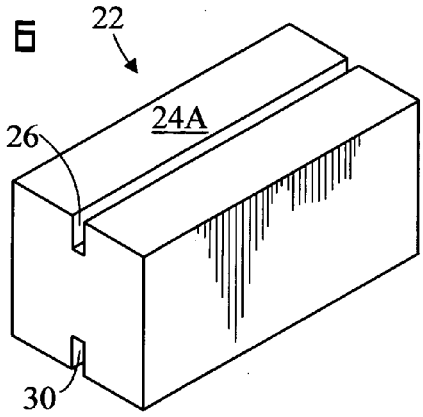
FIG. 6 is a perspective view of the building block.

FIGS. 4-6 are top plan, end elevation, and perspective views respectively of a building block 22. In the shown embodiment building block 22 has six rectangular faces, however building blocks 22 of other shapes are also possible. It is noted that first elongated groove 26 is centered on first side 24 of building block 22, and second elongated groove 30 is centered on second side 28 of building block 22. In the shown embodiment the grooves are linear and oriented along the major axis of building block 22.

Figure 7:
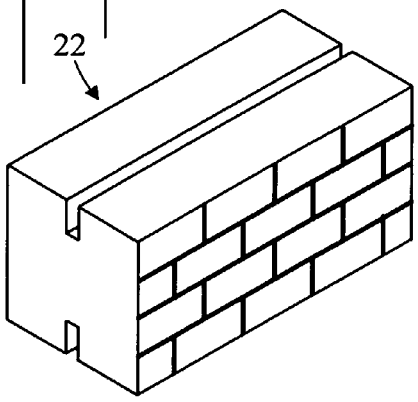
FIG. 7 is a perspective view of a building block having a surface.
Figure 8:
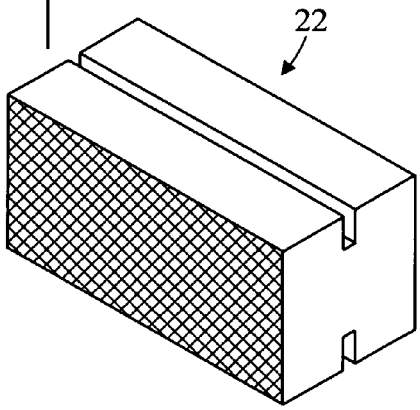
FIG. 8 is an opposite perspective view of the same building block having a different surface.

FIGS. 7-8 are perspective views of a building block 22 having different looking surfaces (textures and colors) to appear realistic. For example, one side of building block 22 could be 24 textured to resemble brick (FIG. 7), while the opposite side is textured and colored to resemble stucco (FIG. 8).

FIGS. 9-12 are enlarged top plan, side elevation, end elevation, and perspective views respectively elongated connector 32. In the shown embodiment elongated connector 32 has a first serrated side 34 and an opposite second serrated side 36. Serrated sides 34 and 36 serve as a gripper which grips the interior walls of elongated grooves 26 and 30 (refer to FIGS. 4-6). The serration also compensates for manufacturing tolerances in the grooves. Also in the shown embodiment, elongated connector 32 has a first chamfered end 38 and an opposite second chamfered end 40. Chamfered ends 38 and 40 facilitate the insertion of connector 32 into the grooves 26 and 30 of building block (also refer to FIGS. 1-3). In one embodiment, elongated connector 32 is about 6 mm high (H) and 3.2 mm wide (W1). In terms of packaging, elongated connector 32 can be provide in a long spool (e.g. 10 meters long) and be cut to length as required, or alternatively can be packaged in bundles (e.g. 25) of a precut length (e.g. 15 centimeters).

Figure 13:
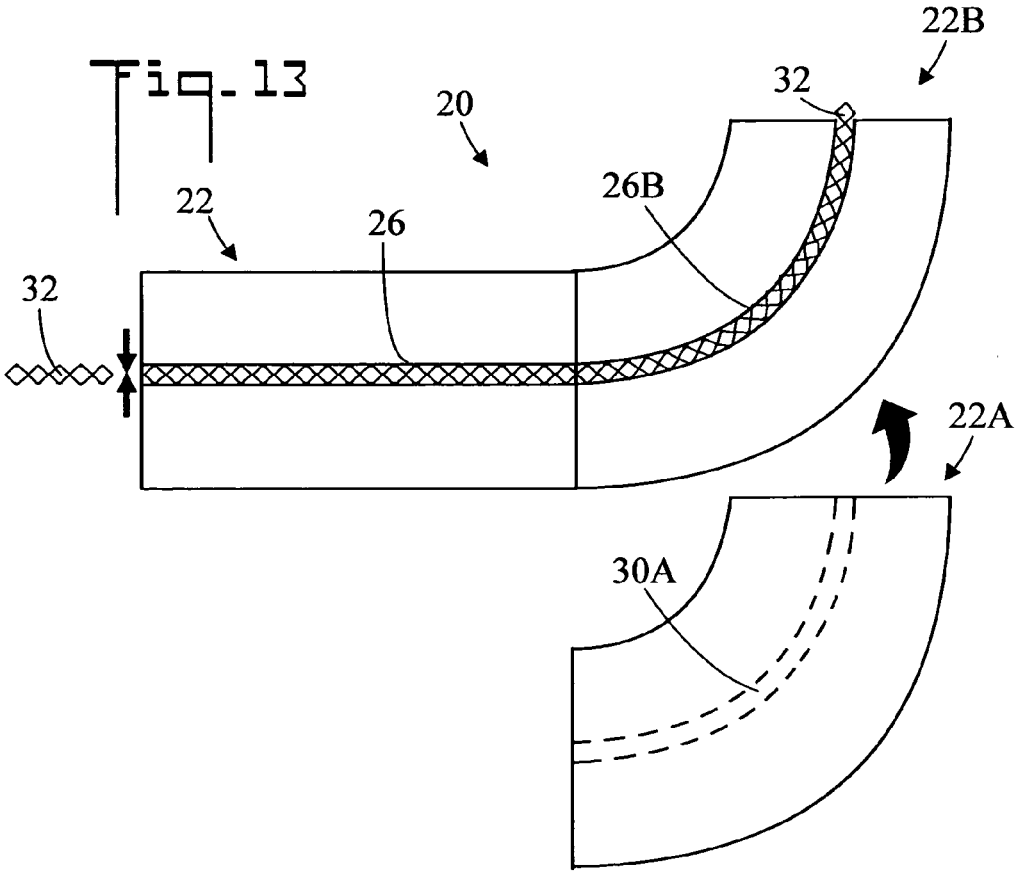
FIG. 13 is a top plan view of a building block having a curved elongated groove.

FIG. 13 is a top plan view of a building block 22B having a curved elongated groove 26B which has been connected by elongated connector 32 to a building block 22 having a straight elongated groove 26. Elongated connector 32 is flexible (being made of a flexible polymer such as nylon) so that it can be received by curved elongated groove 26B and by straight elongated groove 26. Another building block 22A having a curved elongated groove 30A can then be connected to the building block 22B. It is also pointed out, that any portion of elongated connector 32 which overhangs the end of the connected building blocks 22, can simply be cut off with scissors.

Figure 14:
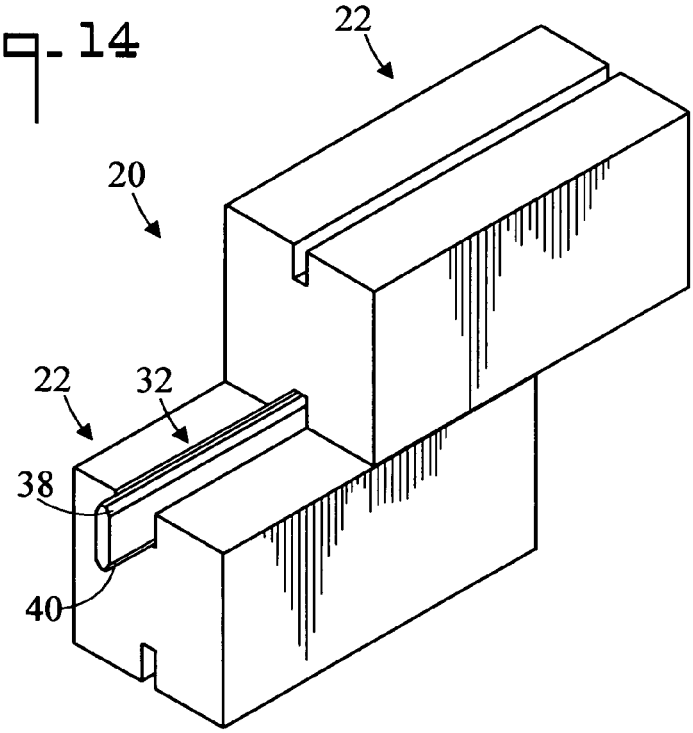
FIG. 14 is a perspective view of the building block system and a second embodiment elongated connector.

FIG. 14 is a perspective view of building block system 20 and a second embodiment elongated connector 32. In this embodiment elongated connector 32 is not serrated, but does include chamfered ends 38 and 40.

Figure 15:
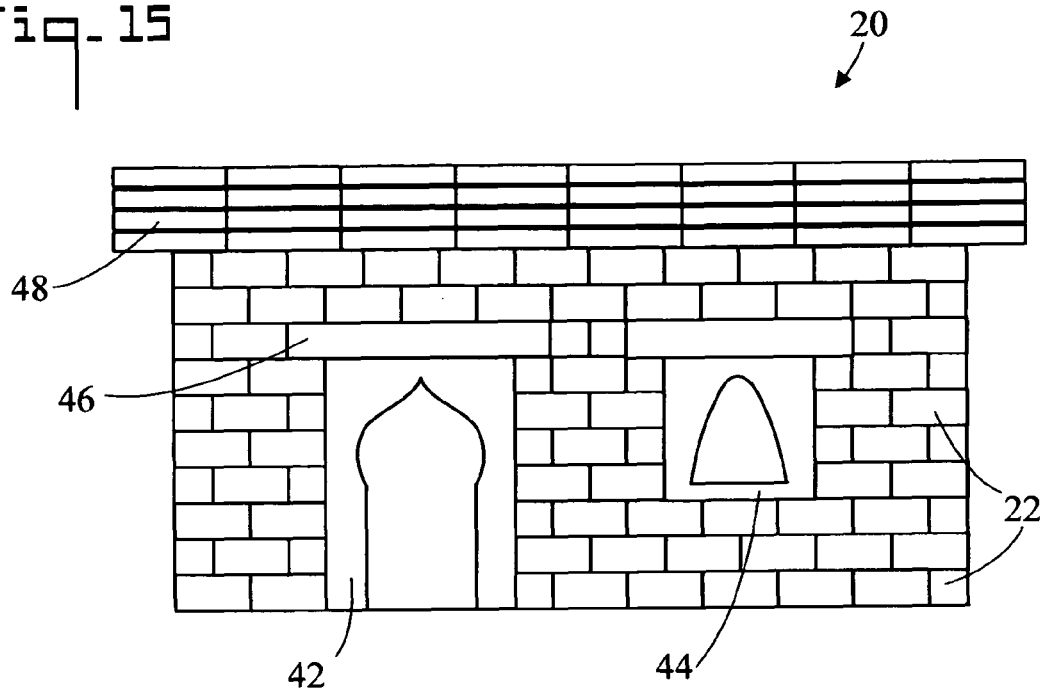
FIG. 15 is a reduced front elevation view of the building block system utilized to build a structure; and, FIG. 16 is a reduced front elevation view of the building block system being held in the hand of a user.

FIG. 15 is a reduced front elevation view of building block system 20 utilized to build a structure such as a house. It is noted that a plurality of building blocks 22 are connected by elongated connectors 32 as shown in FIGS. 1-3. It is also noted that building block system 20 can include half size building blocks 22 to produce a straight edge even when using a staggered off set block arrangement. Also, building block system 20 can included building blocks 22 shaped as doors 42, window 44, lentils 46, and roof members 48, all of which have elongated grooves for accepting elongated connector 32.

Figure 16:
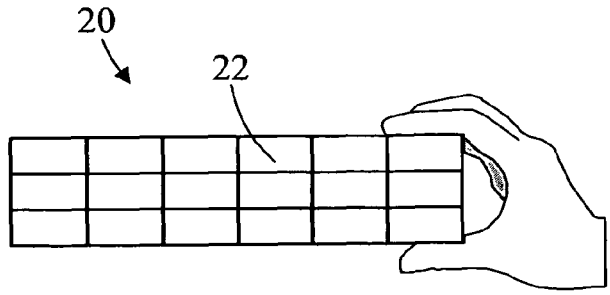

FIG. 16 is a reduced front elevation view of building block system 20 being held in the hand of a user. Because elongated connectors 32 (refer to FIGS. 9-12) are slightly wider than the grooves of building blocks 22, they firmly hold adjacent building blocks 22 together so that the entire building block structure can be picked up as a unit. Also, it is noted that unlike some building block systems, the building blocks 22 disclosed herein can be stacked directly in line on top of other building block 22 without offset staggering such that shown in FIG. 15.

In terms of use, a method for building a structure using building blocks 22 includes, (refer to FIGS. 1-16)

(a) providing a building block system 20 including:

a first building block 22A having a first side 24A having a first elongated groove 26A and an opposite second side 28A having a second elongated groove 30A;

a second building block 22B having a third side 24B having a third elongated groove 26B and an opposite fourth side 28B having a fourth elongated groove 30B; and, an elongated connector 32 which is shaped and dimensioned to be simultaneously snuggly received by second elongated groove 30A of first building block 22A and third elongated groove 26B of second building block 22B;

(b) inserting elongated connector 32 into both second elongated groove 30A of first building block 22A and third elongated groove 26B of second building block 22B, thereby connecting first 22A and second 22B building blocks together;

The method further including:

in step (a), second elongated groove 30A oriented parallel to the first elongated groove 26A, and fourth elongated groove 30B oriented parallel to third elongated groove 26B.

The method further including:

in step (a), first elongated groove 26A centered on first side 24A of first building block 22A; and, in step (a), second elongated groove 30A centered on second side 28A of first building block 22A.

The method further including:

in step (a), first 26A and second 30A elongated grooves 32 of first building block 22A and third 26B and fourth 30B elongated grooves of second building block 22B all having the same width W;

in step (a), elongated connector 32 having a width W1 which is slightly greater than width W of the elongated grooves; and, in step (b), press fitting elongated connector 32 into second 30A and third 26B elongated grooves.

The method further including:

in step (a), first 26A, second 30A, third 26B, and fourth 30B elongated grooves each having the same depth D;

in step (a), elongated connector 32 having a height H, wherein height H is approximately equal to two times depth D; and, after step (b), approximately one half of elongated connector 32 received by second elongated groove 30A of first building block 22A, and about one half of elongated connector 32 received by third elongated groove 26B in second building block 22B.

The method further including:

in step (a), second elongated groove 30A in first building block 22A being curved; and third elongated groove 26B in second building block 22B being curved; and, in step (a), elongated connector 32 being flexible so that in step (b) it can be received by curved second elongated groove 30A and curved third elongated groove 26B.

The method further including:

in step (a), elongated connector 32 having a first serrated side 34 and an opposite second serrated side 36; and, in step (b), first 34 and second 36 serrated sides serving to grip second 30A and third 26B elongated grooves.

The method further including:

in step (a), elongated connector 32 having a first chamfered end 38 and an opposite second chamfered end 40; and, in step (b), first 38 and second 40 chamfered ends facilitating the insertion of elongated connector 32 in to second 30A and third 26B elongated grooves.

The method further including:

after step (b), a portion of elongated connector 32 not connected to either second elongated groove 30A of first building block 22A or to third elongated groove 26B of second building block 22B; and, cutting off the unconnected portion of elongated connector 32.

The method further including:

after step (b), picking up first building block 22A and thereby also picking up second building block 22B The method further including:

in step (a), providing a plurality of additional building blocks 22 and elongated connectors 32; and, using the plurality of additional elongated connectors 32 to connect the plurality of additional building blocks 22 together.

The possible embodiments of the building block system and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the building block system and method of use should be construed as limiting the invention to a particular embodiment or combination of embodiments. The scope of the invention is best defined by the appended claims.

I claim:

1. A building block system, comprising:

a first building block having a first side having a first elongated groove and an opposite second side having a second elongated groove;

a second building block having a third side having a third elongated groove and an opposite fourth side having a fourth elongated groove; and, an elongated connector which is shaped and dimensioned to be simultaneously snuggly received by said second elongated groove of said first building block and said third elongated groove of said second building block, said elongated connector being a separate part which is not permanently connected to either said first building block or said second building block; said first and second elongated grooves of said first building block and said third and fourth elongated grooves of the second building block each being formed by two parallel planar walls;

said elongated connector having a first serrated side and an opposite second serrated side;

said first serrated side having a first plurality of vertices, and said second serrated side having a second plurality of vertices;

when said connector is snuggly received by said second elongated groove of said first building block, said first plurality of vertices contact one of said parallel planar walls and said second plurality of vertices contact the other of said parallel planar walls; and when said connector is snuggly received by said elongated groove of said second building block, said first plurality of vertices contact one of said parallel planar walls and said second plurality of vertices contact the other of said parallel planar walls.

2. The building block system according to claim 1, further including:

at least one additional building block identical to said first building block; and, said elongated connector shaped and dimensioned to be simultaneously snuggly received by said first building block, said second building block, and said at least one additional building block.

3. The building block system according to claim 1, further including:

said first and second elongated grooves of said first building block and said third and fourth elongated grooves of said second building block each being formed by two parallel planar walls;

said first and second elongated grooves of said first building block and said third and fourth elongated grooves of said second building block all having the same width W; and, said elongated connector having a width W1 which is slightly greater than said width W of said elongated grooves, so that said elongated connector can be press fit into said elongated grooves.

4. The building block system according to claim 1, further including:

said first, second, third, and fourth elongated grooves each having the same depth D; and, said elongated connector having a height H, wherein height H is approximately equal to two times said depth D.

5. The building block system according to claim 1, further including:

said first elongated groove being curved; and, said elongated connector being flexible so that it can be received by said curved first elongated groove.

6. The building block system according to claim 1, further including:

said elongated connector having a first chamfered end and an opposite second chamfered end.

7. The building block system according to claim 1, further including:

said first and second elongated grooves of said first building block and said third and fourth elongated grooves of said second building block all having the same width W;

said elongated connector having a width W1 which is slightly greater than said width W of said elongated grooves, so that said elongated connector can be press fit into said elongated grooves;

said first, second, third, and fourth elongated grooves each having the same depth D;

said elongated connector having a height H, wherein height H is approximately equal to two times said depth D;

said first and second elongated grooves of said first building block and said third and fourth elongated grooves of said second building block each being formed by two parallel planar walls;

said elongated connector having a first serrated side and an opposite second serrated side;

said first serrated side having a first plurality of vertices, and said second serrated side having a second plurality of vertices;

when said connector is snuggly received by said second elongated groove of said first building block, said first plurality of vertices contact one of said parallel planar walls and said second plurality of vertices contact the other of said parallel planar walls;

when said connector is snuggly received by said third elongated groove of said second building block, said first plurality of vertices contact one of said parallel planar walls and said second plurality of vertices contact the other of said parallel planar walls; and, said elongated connector having a first chamfered end and an opposite second chamfered end.

8. A method for building a structure using building blocks, comprising:

(a) providing a building block system including:

a first building block having a first side having a first elongated groove and an opposite second side having a second elongated groove;

a second building block having a third side having a third elongated groove, and an opposite fourth side having a fourth elongated groove;

an elongated connector which is shaped and dimensioned to be simultaneously snuggly received by said second elongated groove of said first building block and said third elongated groove of said second building block;

said elongated connector being a separate part which is not permanently connected to either said first building block or said second building block;

(b) inserting said elongated connector into both said second elongated groove of said first building block and said third elongated groove of said second building block, thereby connecting said first and second building blocks; in step (a), said first and second elongated grooves of said first building block and said third and fourth elongated grooves of the second building block each being formed by two parallel planar walls;

in step (a), said elongated connector having a first serrated side and an opposite second serrated side;

in step (a), said first serrated side having a first plurality of vertices, and said second serrated side having a second plurality of vertices;

in step (b), when said connector is snuggly received by said second elongated groove of said first building block, said first plurality of vertices contact one of said parallel planar walls and said second plurality of vertices contact the other of said parallel planar walls; and in step (b), when said connector is snuggly received by said elongated groove of said second building block, said first plurality of vertices contact one of said parallel planar walls and said second plurality of vertices contact the other of said parallel planar walls.

9. The method of claim 8, further including:

in step (a), said first and second elongated grooves of said first building block and said third and fourth elongated grooves of said second building block each being formed by two parallel planar walls;

in step (a), said first and second elongated grooves of said first building block and said third and fourth elongated grooves of said second building block all having the same width W;

in step (a), said elongated connector having a width W1 which is slightly greater than said width W of said elongated grooves; and, in step (b), press fitting said elongated connector into said second and third elongated grooves.

10. The method of claim 8, further including:

in step (a), said first, second, third, and fourth elongated grooves each having the same depth D;

in step (a), said elongated connector having a height H, wherein height H is approximately equal to two times said depth D; and, after step (b), approximately one half of said elongated connector received by said second elongated groove of said first building block, and about one half of said elongated connector received by said third elongated groove in said second building block.

11. The method of claim 8, further including:

in step (a), said second elongated groove in said first building block being curved, and said third elongated groove in said second building block being curved; and, in step (a), said elongated connector being flexible so that in step (b) it can be received by said curved second elongated groove and said curved third elongated groove.

12. The method of claim 8, further including:

in step (a), said elongated connector having a first chamfered end and an opposite second chamfered end; and, in step (b), said first and second chamfered ends facilitating said insertion of said elongated connector in to said second and third elongated grooves.

13. The method of claim 8, further including:

after step (b), a portion of said elongated connector not connected to either said second elongated groove of said first building block or to said third elongated groove of said second building block; and, cutting off said unconnected portion of said elongated connector.

14. The method of claim 8, further including:

in step (a), providing at least one additional building block identical to said first building block, said elongated connector shaped and dimensioned to be simultaneously snuggly received by said first building block, said second building block, and said at least one additional block; and after step (b), connecting said at least one additional building block to said first and second building blocks.

* * * * *